US007156709B1

(12) United States Patent
Staerzl et al.

(10) Patent No.: US 7,156,709 B1
(45) Date of Patent: Jan. 2, 2007

(54) METHOD FOR CONTROLLING THE TILT POSITION OF A MARINE PROPULSION DEVICE

(75) Inventors: Richard E. Staerzl, Fond du Lac, WI (US); Michael P. Dengel, Fond du Lac, WI (US); Daniel D. Treptow, Cedarburg, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/479,503

(22) Filed: Jun. 30, 2006

(51) Int. Cl.
*B63H 5/125* (2006.01)

(52) U.S. Cl. ..... 440/61 T; 440/61 G

(58) Field of Classification Search ..... 440/61 T, 440/61 G

See application file for complete search history.

(56) References Cited

U.S. PATENT DOCUMENTS

| | | | | |
|---|---|---|---|---|
| 3,722,455 | A | 3/1973 | Carpenter | 115/41 HT |
| 4,051,801 | A | 10/1977 | Woodfill et al. | 115/12 R |
| 5,073,133 | A | 12/1991 | Inoue | 440/1 |
| 5,142,473 | A | 8/1992 | Davis | 364/424.01 |
| 5,352,137 | A * | 10/1994 | Iwai et al. | 440/1 |
| 5,662,213 | A | 9/1997 | Kattler et al. | 200/302.3 |
| 6,149,476 | A * | 11/2000 | Eilert | 440/53 |
| 6,183,321 | B1 | 2/2001 | Alby et al. | 440/61 |
| 6,620,006 | B1 * | 9/2003 | Suganuma et al. | 440/77 |
| 2003/0013359 | A1 * | 1/2003 | Suganuma et al. | 440/77 |

* cited by examiner

*Primary Examiner*—Stephen Avila
(74) *Attorney, Agent, or Firm*—William D. Lanyi

(57) ABSTRACT

The calibration procedure allows an upward maximum limit of tilt to be automatically determined and stored as an operator rotates a marine propulsion device relative to a marine vessel with a particular indication present. That indication can be a grounded circuit point which informs a microprocessor that at calibration procedure is occurring in relation to an upward trim limit. When the ground wire is removed or disconnected from the circuit point, the microprocessor knows that the calibration process is complete. During the rotation of the outboard motor or marine propulsion device in an upward direction, both the angular position of the outboard motor and the direction of change of a signal from a trim sensor are stored.

17 Claims, 4 Drawing Sheets

METHOD FOR CONTROLLING THE TILT POSITION OF A MARINE PROPULSION DEVICE

BACKGROUND OF THE INVENTION

1. Field of the Invention

The present invention is generally related to a tilt, or trim, system for a marine propulsion device and, more particularly, to a method for programming an upper limit for the trim position of an outboard motor in a way that facilitates a precise setting of an end-of-travel position beyond which the outboard motor will not subsequently be tilted.

2. Description of the Related Art

Many different systems are well known to those skilled in the art for the purpose of trimming or tilting a marine propulsion device.

U.S. Pat. No. 4,051,801, which issued to Woodfill et al. on Oct. 4, 1977, discloses a drive position signaling apparatus. A marine jet drive includes a nozzle which is mounted in a gimbal ring for pivoting about a horizontal axis for trimming of the drive jet. An electric motor drives a gear train including a rotating actuator shaft having an Acme nut actuator connected by a rigid linkage to the gimbal ring for trim positioning of the nozzle. A potentiometer is mounted within the gear housing with an input shaft parallel to the actuator shaft.

U.S. Pat. No. 3,722,455, which issued to Carpenter on Mar. 27, 1973, describes a hydraulic power trim and power tilt system for a marine propulsion device. An outboard motor includes a first extensible hydraulic cylinder means pivotally connected between a transom bracket and a swivel bracket to afford power tilting and, in response to the striking of an underwater obstacle, to afford energy absorption, together with a second extensible hydraulic cylinder means having an extensible part and mounted on the transom bracket with the extensible part positioned for engagement with the swivel bracket to afford trim adjustment.

U.S. Pat. No. 5,073,133, which issued to Inoue on Dec. 17, 1991, describes a fuel supplying system for an engine of an outboard motor. An arrangement for insuring that an internal combustion engine of an outboard motor will operate efficiently under all trim adjusted conditions of the outboard motor is described. The trim angle is sensed and the fuel delivery system is adjusted to provide good running in response to the trim condition. Additionally, embodiments are disclosed wherein the fuel delivery system is also adjusted during initial starting so as to provide adjustment of the fuel delivery in response to both the starting condition and the trim condition. Both carbureted and fuel injected systems are described.

U.S. Pat. No. 5,142,473, which issued to Davis on Aug. 25, 1992, describes a speed, acceleration, and trim control system for power boats. A computer-based system controls speed, speed and acceleration and/or trim. Trim control is responsive to sensed inclination. Inclination/acceleration is sensed by an inclinometer/accelerometer having an electrically conductive fluid that flows within a conduit. The fluid assumes different positions in its flow path under differing gravitational and acceleration forces. A multiplicity of pins, positionally arrayed along the fluid flow path within the conduit, electrically sense the presence, or absence, of the fluid at a corresponding position within its flow path.

U.S. Pat. No. 5,662,213, which issued to Kattler et al. on Sep. 2, 1997, describes a trim switch with a waterproof boot. The trim switch is intended for mounting in an opening in an outboard motor cowl. The trim switch includes an outer housing which overlies a rocker assembly. The rocker assembly includes a rocker and a rocker support housing. The rocker support housing defines an interior region in which terminals and a terminal bridging contact are disposed.

U.S. Pat. No. 6,183,321, which issued to Alby et al. on Feb. 6, 2001, discloses an outboard motor with a hydraulic pump and an electric motor located within a steering mechanism. The outboard motor comprises a pedestal which is attached to a transom of a boat, a motor support platform that is attached to the outboard motor, and a steering mechanism that is attached to both the pedestal and the motor support platform. It comprises a hydraulic tilting mechanism that is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

U.S. Pat. No. 6,620,006, which issued to Suganuma et al. on Sep. 16, 2003, describes a trim and tilt control and cowling arrangement for a marine drive. The outboard motor includes a cowling substantially enclosing an engine therein. A tilt and trim mechanism includes a manually-actuable tilt switch for controlling tilt and trim of the motor. Both the port and starboard sidewalls of the cowling have apertures formed therethrough. The apertures are sized and configured to accommodate a tilt switch. In one embodiment, a tilt switch is arranged in one aperture and a plug is arranged in the other aperture. In another embodiment, tilt switches are arranged in both apertures.

The patents described above are hereby expressly incorporated by reference in the description of the present invention.

In a typical arrangement using an outboard motor attached to the transom of a marine vessel, limit switches of one type or another are provided in order to stop the rotational movement of the outboard motor about its tilt axis. This is particularly true with regard to the upper position of the outboard motor when it is tilted to raise the propeller of the marine propulsion device out of the water. In relation to certain styles of boat design, the outboard motor can be tilted upwardly to a sufficient degree that damage can occur within the rear portion of the marine vessel, or to the cowl, when upper and forward portions of the outboard motor are moved into contact with portions of the marine vessel or accessories located in front of the outboard motor. The proper positioning of limit switches in relation to this uppermost trim position is sometimes difficult to achieve. It would therefore be significantly beneficial if a system or method could be provided in which an upper tilt limit is set automatically without the need for limit switches to be accurately positioned and attached to the marine vessel or to a stationary portion of the marine propulsion device.

SUMMARY OF THE INVENTION

A method for operating a trim system for a marine propulsion device, in accordance with a particularly preferred embodiment of the present invention, comprises the steps of providing a sensor which is configured to transmit a first signal which is representative of a position of the marine propulsion device, causing the marine propulsion device to move in a desired uppermost trim position, receiving a second signal which is indicative of a change in a monitored condition, and storing a magnitude of the first signal when the change in the monitored condition occurs. In other words, when the second signal indicates that the change in the monitored condition occurs, the magnitude of the first signal is saved for later use as an upper limit to the travel of the marine propulsion device.

A preferred embodiment of the present invention can further comprise the step of determining the direction of change of the magnitude of the output signal. A preferred embodiment of the present invention further comprises the step of setting a trim limit magnitude which is a function of both the direction of change of the magnitude of the output signal and the magnitude of the first signal when the change in the monitored condition occurs.

In one embodiment of the present invention, it can further comprise the step of determining, as a function of the direction of change, the side of the marine propulsion device on which the sensor is attached.

The second signal, which is indicative of the change in the monitored condition, changes state when a ground wire is disconnected from signal communication with a microprocessor in a particularly preferred embodiment of the present invention. Also, in a preferred embodiment of the present invention, the sensor is a potentiometer and the causing step comprises the step of responding to a manually caused actuation of a switch by energizing a hydraulic cylinder to cause the marine propulsion device to tilt upwardly relative to the marine vessel to which it is attached.

In a preferred embodiment of the present invention, the manually actuated switch, which causes the marine propulsion device to rotate about its trim access in an upward direction, is located on the marine propulsion device. During the initial setup of the trim limit, an operator can stand near the marine propulsion device and manually cause it to tilt upwardly by actuating the switch located on the marine propulsion device. When the marine propulsion device, such as an outboard motor, is rotated upwardly to a position that is deemed proper to be used as an upper limit, the second signal is provided by the operator and that upper limit is stored for future use. The second signal, in a preferred embodiment of the present invention, is a ground wire that is removed from a circuit for the purpose of causing the present magnitude of the first signal to be stored as the upper limit.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 2:
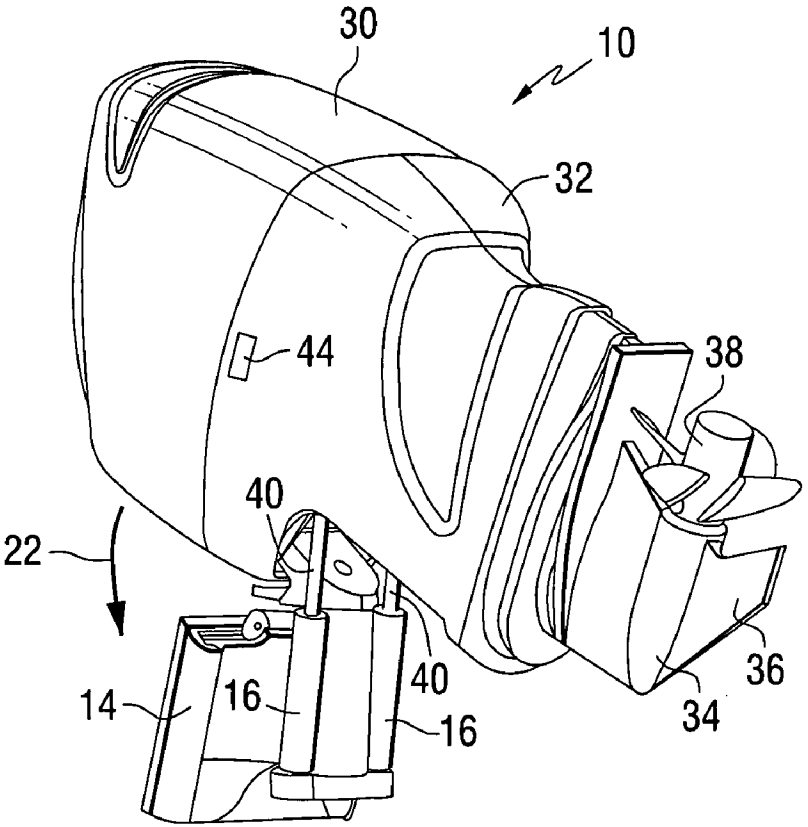
FIG. 2 is an isometric view of the marine propulsion device of FIG. 1 in an upwardly trimmed position.

Throughout the description of the preferred embodiment of the present invention, like components will be identified by like reference numerals.

Figure 1:
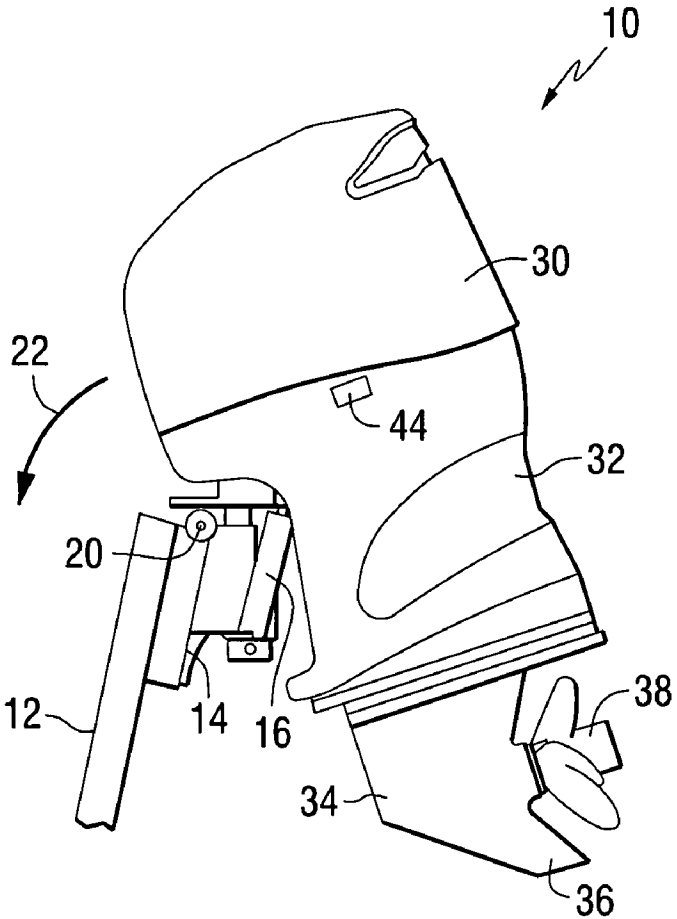
FIG. 1 is a side view of a marine propulsion device attached to a transom of a marine vessel.

FIG. 1 is a side view of a marine propulsion device 10, such as an outboard motor, which is attached to a transom 12 of a marine vessel. A transom bracket 14 facilitates the attachment of the support mechanism for the outboard motor to the transom 12. A hydraulic cylinder 16 is configured to exert a force on the outboard motor to cause it to rotate about a tilt axis 20. When the outboard motor is tilted upwardly, it moves about the tilt axis 20 in the direction represented by arrow 22.

With continued reference to FIG. 1, the outboard motor 10 typically comprises a cowl structure 30, a driveshaft housing 32, a lower unit comprising a gear case 34 and skeg 36, and a propeller 38 attached to a propeller shaft (not visible in FIG. 1) that is supported within the gear case 34 for rotation about a generally horizontal axis when the marine propulsion device 10 is operational. The outboard motor is typically trimmed about its tilt axis 20 to facilitate an efficient operation of the marine propulsion device. When the marine vessel is transported on land, the marine propulsion device 10 is typically rotated upwardly, as represented by arrow 22, to a maximum upper position. In some instances, an additional physical support is provided to hold the outboard motor in the upwardly tilted position.

FIG. 2 is an isometric view of the marine propulsion device 10 in an upwardly tilted position at approximately its maximum position of rotation. The hydraulic cylinders 16 are illustrated with their piston rods 40 extended from them at approximately their maximum position of extension. Also shown in FIG. 2 are the cowl 30, the driveshaft housing 32, the gear case 34, the skeg 36, and the propeller 38. The transom 12, discussed above in conjunction with FIG. 1, is not illustrated in FIG. 2, but the transom bracket 14 is shown.

With continued reference to FIGS. 1 and 2, a switch 44 is illustrated on the port side of the marine propulsion device 10. This switch is a trim switch that is operable to cause the outboard motor to rotate about its tilt axis 20. A different trim switch is typically provided near the helm of the marine vessel. However, the switch 44 is located on the marine propulsion device 10 so that an operator of the marine vessel can adjust the angle of trim of the outboard motor while standing at a position behind the marine vessel.

With continued reference to FIGS. 1 and 2, it should be understood that certain marine vessels are configured in such a way that potential damage can possibly occur if the outboard motor 10 is rotated in the direction identified by arrow 22 by an excessive amount. Typically, the cowl 30 can be damaged if it moves into contact with components of the marine vessel that are located in front of the outboard motor. By rotating the marine propulsion device 10 to an excessive degree, possibly beyond the position illustrated in FIG. 2, portions of the marine vessel and portions of the cowl 30 can be damaged as the hydraulic cylinder 16 continues to force the outboard motor to rotate about its tilt axis beyond an appropriate upper limit. The upper limit of travel, in known marine propulsion systems, is typically identified by a maximum signal from a sensor or a physically actuated limit switch provided on the marine propulsion device. In other words, the tilt system of the outboard motor is typically provided with some means to identify an over-travel condition prior to the piston rods 40 reaching their maximum possible travel. These limits are typically preset by a boat builder when the marine propulsion device 10 is assembled to the marine vessel. However, since many different styles of boats are available, the accurate setting of the upper trim limit necessitates a careful configuration of various switches or limits contained in a microprocessor.

The present invention provides a simplified method for setting an upper trim limit that can subsequently be used by a microprocessor to determine when that upper limit is reached during a rotation of the outboard motor in the direction identified by arrow 22 in FIGS. 1 and 2.

Figure 3:
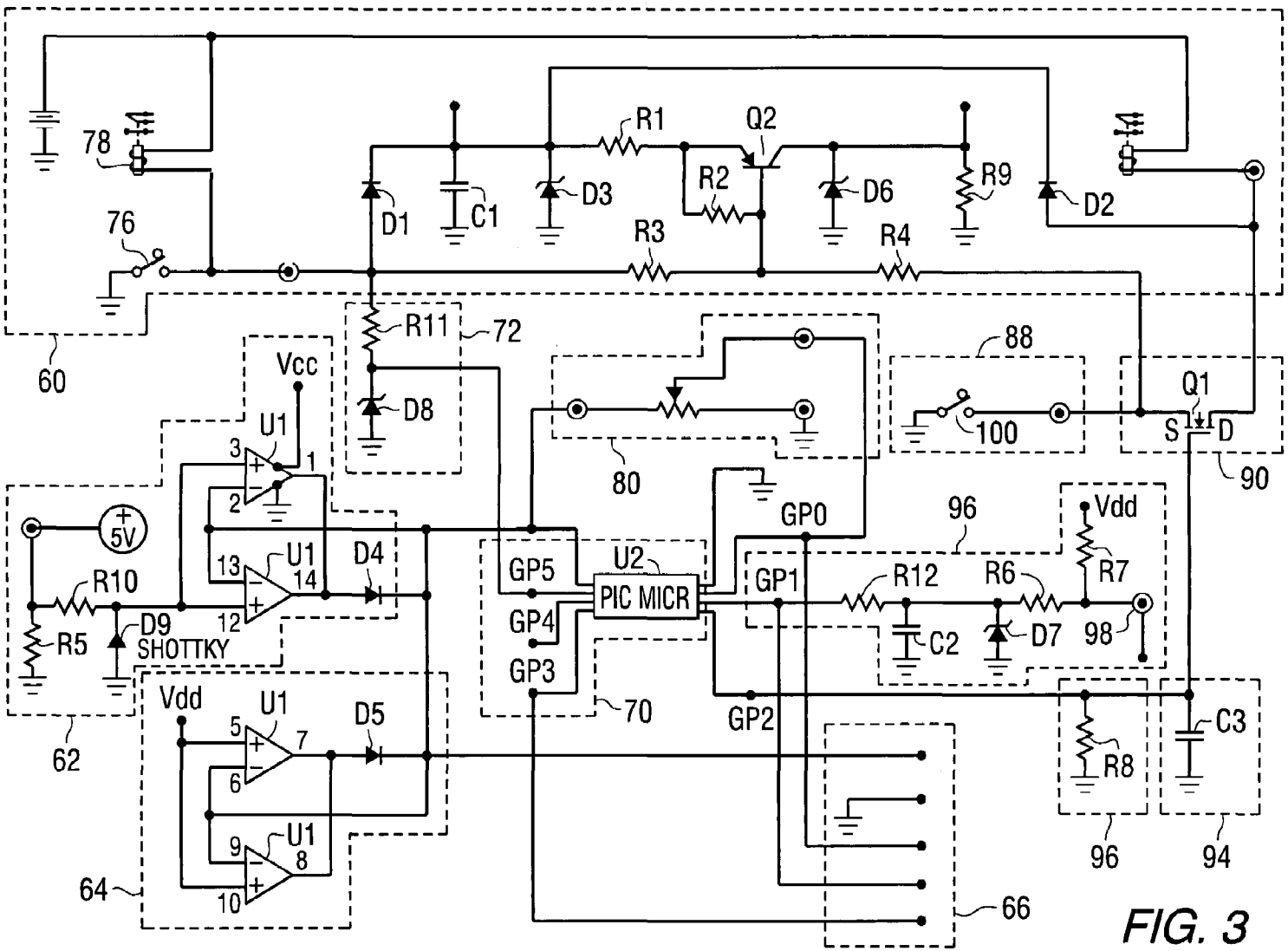
FIG. 3 is an electric circuit used to perform some of the functions of the present invention.
Figure 4:
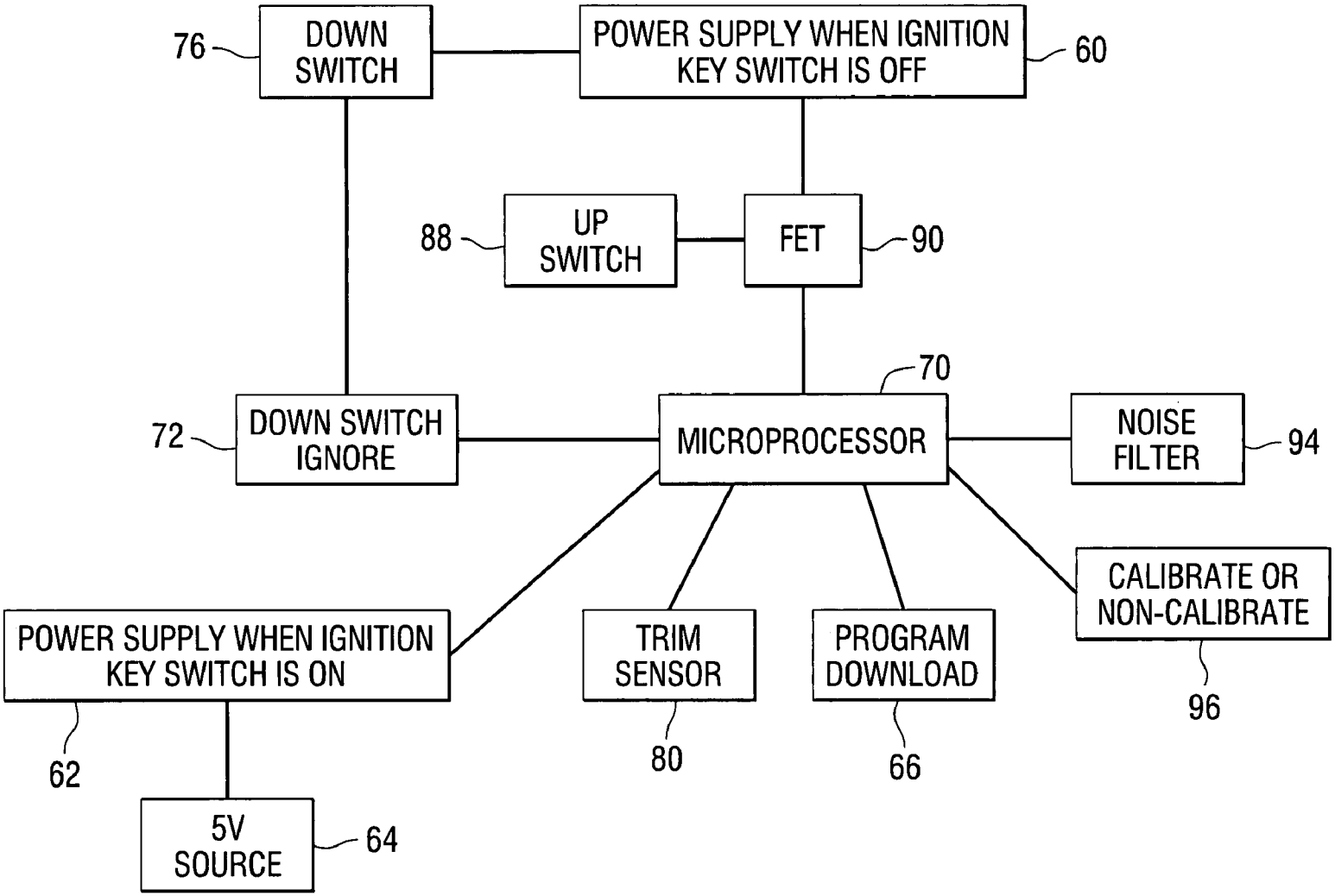
FIG. 4 is a simplified schematic representation of the electrical circuit of FIG. 3.

FIG. 3 is an electric circuit used in conjunction with present invention and FIG. 4 is a highly simplified schematic representation of the basic portions of the circuit shown in FIG. 3. Table I identifies the type or value of the components illustrated in FIG. 3. Although those skilled in the art of electronic control systems are familiar with the individual operation of the components and sub-circuits illustrated in FIG. 3, the basic operation and function of the sub-circuits will be described below.

TABLE I

| REFERENCE | VALUE OR TYPE |
|---|---|
| R1 | 240 Ω |
| R2 | 1k Ω |
| R3 | 1k Ω |
| R4 | 1k Ω |
| R5 | 1k Ω |
| R6 | 1k Ω |
| R7 | 1k Ω |
| R8 | 1k Ω |
| R9 | 10k Ω |
| R10 | 10k Ω |
| R11 | 1M Ω |
| R12 | 10k Ω |
| C1 | 0.1 μF |
| C2 | 0.1 μF |
| C3 | 0.1 μF |
| U1 | LP324 |
| U2 | PIC12F675 |
| D1 | SA1 |
| D2 | SA2 |
| D3 | SMAJ15A-TR |
| D4 | BAS21 |
| D5 | BAS21 |
| D6 | BZX84C5V1 |
| D7 | BZX84C5V1 |
| D8 | BZX84C5V1 |
| Q2 | MMBTA56 |

With continued reference to Table I and FIGS. 3 and 4, the portion of the circuit identified by reference numeral 60 provides a five volt power supply to the other portions of the circuit when the ignition key switch of the marine vessel is off. The portion of the circuit in FIG. 3 identified by reference numeral 62, and shown in FIG. 4, provides power for the circuit when the ignition key of the marine vessel is on. This portion 62 of the circuit works in cooperation with the components identified by reference numeral 64 to provide the five volt source. The connection points shown within dashed box 66 are points that can be used to download programs into the microprocessor 70. The circuit portion identified by reference numeral 72 results in the microprocessor 70 ignoring signals from the trim sensor when the marine propulsion device is being rotated in a downwardly direction opposite to the direction identified by arrow 22 in FIGS. 1 and 2. The down switch itself is identified by reference numeral 76 in FIGS. 3 and 4 and its associated down relay 78 is shown in FIG. 3.

With continued reference to FIGS. 3 and 4, the trim position sensor is identified by reference numeral 80 and the up switch, which is located on the marine propulsion device itself, is identified by reference numeral 88. Also shown in FIGS. 3 and 4 is a field effect transistor (FET) Q1 which is also identified by reference numeral 90 in FIGS. 3 and 4. Reference numeral 94 identifies a noise filter and reference numeral 96 is a resistor R8 which provides an appropriate load for the gate of the field effect transistor 90. The components in dashed box 96 allow the microprocessor to receive a signal that represents whether or not the circuit is in a calibrate mode or a non-calibrate mode. More specifically, the point identified by reference numeral 98 in FIG. 3 is either grounded (i.e. in a calibrate mode) or ungrounded (in a non-calibrate mode).

With continued reference to FIGS. 3 and 4, the basic method of the present invention will be described. With circuit point 98 grounded, indicating that the system is in a calibration mode, an operator manually depresses the up switch 100 in dashed box 88 to cause the outboard motor to rotate in the direction indicated by arrow 22 in FIGS. 1 and 2. This upward rotation can be accomplished in several steps as the operator continues to visually monitor whether or not the cowl 30 or other portions of the outboard motor are moving into potential contact with items located in front of the outboard motor. When the outboard motor 10 is in its maximum upwardly rotated position, the operator can remove the ground wire from point 98. The removal of this ground provides information to the microprocessor U2 in dashed box 70, informing it that the most recently received position of the outboard motor, from the trim sensor 80, should be used in the future as an upper maximum position when the operator of the marine vessel requests an upward trim movement. As long as circuit point 98 remains ungrounded, the microprocessor U2 in dashed box 70 will not change this stored value or magnitude received from the trim sensor 80. Although the position represented by the signal from the trim sensor 80 will be used to inform the microprocessor of the current angle of tilt of the outboard motor 10, the stored magnitude that represents the upper limit of this rotation will not change as long as circuit point 98 remains ungrounded.

Figure 5:
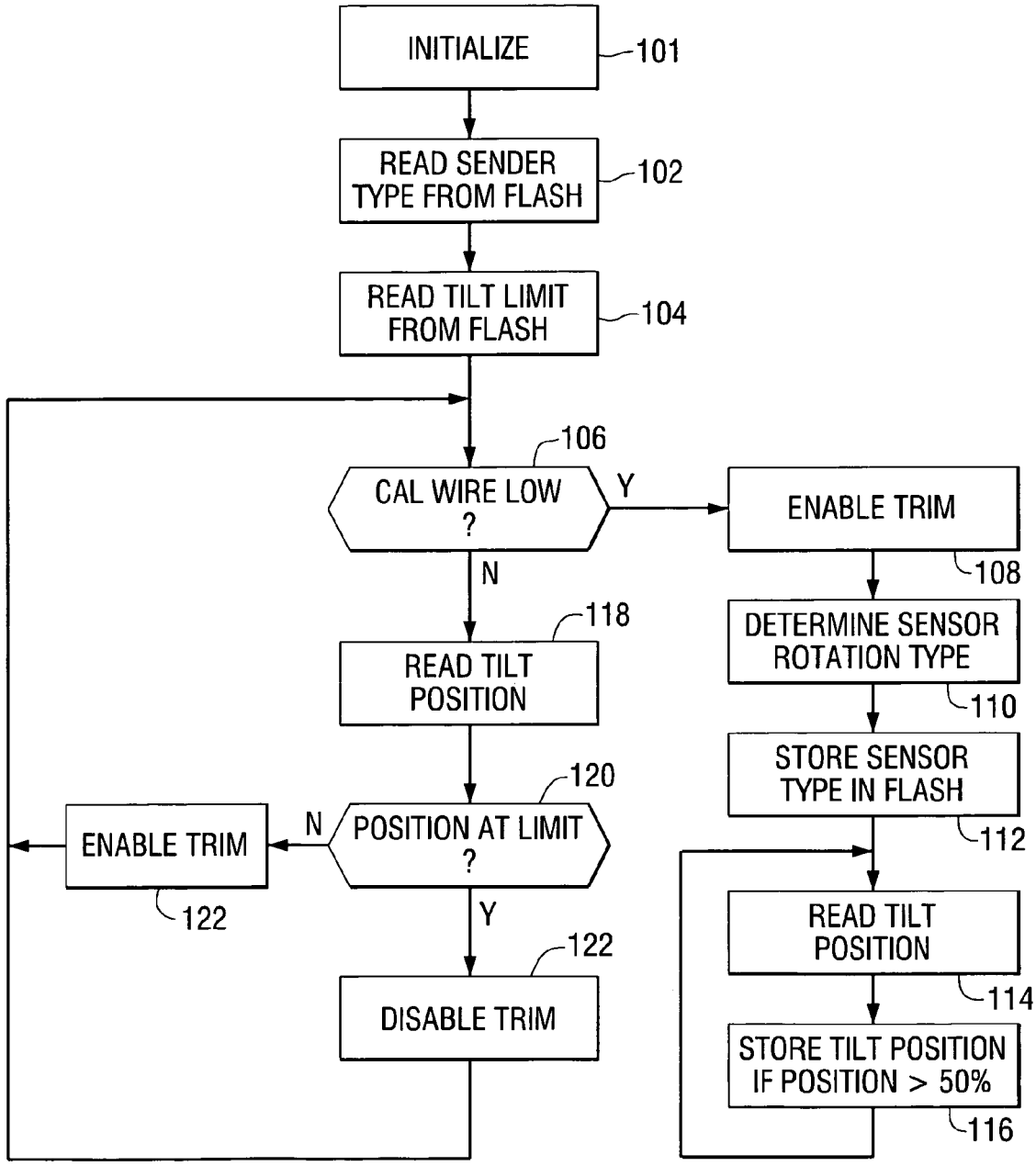
FIG. 5 is a flowchart showing the basic steps of the present invention.

FIG. 5 is a simplified flowchart describing the process performed by the microprocessor U2 within dashed box 70 of the circuit described above in conjunction with FIG. 3. Beginning with a basic initialization step 101, the microprocessor reads the signal from the trim sensor 80 at functional block 102 and then reads a trim limit magnitude currently stored in the memory of the microprocessor U2. This is identified at functional block 104. If the calibration wire, at circuit point 98, is grounded as detected at functional block 106, the upward trimming of the outboard motor, in response to closure of switch 100 in dashed box 88, is enabled at functional block 108. The changing signal received from the trim sensor 80 is monitored at functional block 110 and the direction of change of that signal is determined. This step identified by reference numeral 110 is performed so that the microprocessor U2 can determine whether the sensor is located on the port or starboard side of the outboard motor.

As is known to those skilled in the art of marine propulsion systems, mounting the sensor on the port or starboard side will have the effect of causing the signal provided by the sensor to either increase or decrease as the outboard motor is trimmed upwardly as indicated by arrow 22 in FIGS. 1 and 2. As the outboard motor is trimmed upwardly by actuation of the switch 44 by the operator during the calibration of the system, this upward or downward change in the magnitude of the signal provided by the sensor 80 is monitored by the microprocessor and a determination can therefore be made as to whether it should be expected that the signal increase or decrease during an upward trimming operation after the calibration is completed. The most recently read signal from the trim sensor 80 is stored at functional block 112 in the flash memory of the microprocessor. The tilt position is repeatedly read by the microprocessor as indicated at functional block 114 and the value is saved as indicated by functional block 116. This continues until the operator stops causing the upward tilt by depressing switch 100 within dashed box 88 of FIG. 3.

If the ground wire at circuit point 98 is disconnected and that point, identified as GP1 in FIG. 3 is no longer grounded, this condition is detected at functional block 106 and the tilt position is again read at functional block 118. The signal received from the trim sensor 80 provides the information at functional block 118 and that information is compared, at functional block 120, to the stored limit value derived during the steps between functional block 108 and functional block 116 as described above. If the trim position is at or above the stored limit, further response to switch 100 is disabled at functional block 122. This prevents the outboard motor from being further rotated into a position where damage could occur. If the current position provided by the trim sensor 80 is not greater than the stored maximum, further rotation of the outboard motor is permitted at functional block 122. From there, the steps located in the bottom left portion of the flowchart of FIG. 5 are repeated.

With continued reference to FIGS. 1–5, a preferred embodiment of the present invention uses a trim position sensor, such as that represented within dashed box 80 in FIG. 3, that comprises a Hall Effect sensor or a potentiometer. The specific construction of the trim position sensor is not limiting to the present invention, but a preferred embodiment of the present invention uses a trim position sensor which provides an analog signal. The signal, in a preferred embodiment, is a voltage that varies from approximately zero volts to approximately five volts. That sensor is positioned near the tilt axis 20. The views of FIGS. 1 and 2 do not specifically show the sensor, but it should be understood that it is attached to the components very near the tilt axis 20 in a preferred embodiment. Some types of sensors, such as a Hall Effect sensor, can be attached to both stationary and rotatable members of the structure so that a magnet is moved relative to a Hall Effect device. If a potentiometer is used, the sensor is mounted near the tilt axis so that a wiper member is moved relative to a stationary conductor to result in a DC voltage signal representing the angular position of the outboard motor relative to a stationary component such as the transom bracket 114.

With continued reference to FIGS. 1–5, the method for operating the trim system for a marine propulsion device, in accordance with a particularly preferred embodiment of the present invention, comprises the steps of providing a sensor 80 which is configured to transmit a first signal which is representative of a position of the marine propulsion device 10 relative to a stationary component, such as a transom bracket 14. The method further comprises the step of causing the marine propulsion device to move to a desired uppermost trim position. This is accomplished when the operator manually causes switch 44, which is identified by reference numeral 100 within dashed box 88 in FIG. 3, to provide an upward command to the field effect transistor 90. That signal from the up switch is connected to the source of the field effect transistor (FET). The method further comprises the step of receiving a second signal, such as the grounding or ungrounding of circuit point 98, which is indicative of a change in a monitored condition. The removal of the ground wire from circuit point 98 represents the change in the monitored condition which is received by the microprocessor U2 in dashed box 70. The present invention further comprises the step of storing a magnitude of the first signal, received from the trim sensor 80, when the change in the monitored condition (e.g. the ungrounding of circuit point 98) occurs.

The present invention can further comprise the step of determining the direction of change of a magnitude of the output signal as the operator causes the outboard motor to rotate in the direction of arrow 22 about the tilt axis 20. Since signals from the trim sensor 80 are not received when the outboard motor is trimmed in the direction opposite to arrow 22, the changes in magnitude of the first signal can be monitored by the microprocessor to determine whether the voltage provided by the sensor 80 is increasing or decreasing. This information allows the microprocessor to determine the direction of change of these signals as the outboard motor is trimmed upwardly in the direction of arrow 22.

With continued reference to FIGS. 1–5, the method of the present invention can further comprise the step of setting a trim limit magnitude which is a function of the direction of change of a magnitude of the first signal and the magnitude of the first signal when the change in the monitored condition occurs. In other words, when the ground wire is disconnected from circuit point 98, the microprocessor U2 possesses two valuable pieces of information. First, it possesses a digital number that is equivalent, and a function of, the analog value provided by the sensor 80 which represents the angular position of the outboard motor. The microprocessor also knows whether or not this first signal from the trim sensor 80 has been increasing or decreasing as the outboard motor is trimmed in the direction of arrow 22. With these two valuable pieces of information, the microprocessor can determine that a viable range of travel is associated with numbers that are either greater than or lesser than the magnitude of the first signal obtained when the ground wire was initially removed from circuit point 98.

A preferred embodiment of the present invention can further comprise the step of determining, as a function of the direction of change, to which side of the marine propulsion device the sensor is attached. The attachment of the sensor, to either the port or starboard side of the outboard motor, will result in the voltage signal from the sensor 80 increasing or decreasing as the outboard motor is rotated in the direction of arrow 22. The sensor can be a potentiometer. In this description of the preferred embodiment of the present invention, the potentiometer can be a sensor that comprises a movable conductor that passes over another conductor to change the effective resistance between two points associated with the sensor. Alternatively, the use of the term potentiometer can also refer to an equivalent device, such as a Hall Effect sensor, that provides an output signal that represents an angular position of the outboard motor as it is trimmed upwardly or downwardly.

The causing step of the present invention typically comprises the step of responding to a manually caused actuation of a switch located on the marine propulsion device by energizing a hydraulic cylinder to cause the marine propulsion device to tilt upwardly relative to a marine vessel.

Throughout the description of the preferred embodiment of the present invention, it has been described as a method for setting a maximum upper tilt limit for an outboard motor. It has also been described as having, in a particularly preferred embodiment, a switch 44 located on the outboard motor so that the operator can stand near the outboard motor and manually cause it to tilt upward in order to select the appropriate maximum position. When that maximum upward position is selected, the second signal is provided which, in a preferred embodiment, is the lifting of a ground contact which indicates that the current position should be used as the upper limit for future use of the outboard motor. Typically, this application of the present invention is used to set the upper tilt limit that would later be used for transporting the marine vessel from one body of water to another. However, it should be understood that the present invention serves another useful purpose which is similar, but not identical, to the purpose described above.

The operator of a marine vessel often selects a preferred trim angle to be used during operation of the marine vessel. As such, the operator of the marine vessel can place the outboard motor at a first trim position during initial acceleration to a planing position of the boat. After the boat is on plane, the operator sometimes re-trims the outboard motor to a more appropriate trim angle for operation at higher speeds. In known marine propulsion systems, the operator must manually trim the outboard motor upwardly while seeking that optimum trim angle. If the outboard motor is trimmed beyond the optimum angle, the operator of the marine vessel must downwardly trim the outboard in order to progressively search for the optimum position. A microprocessor associated with the marine propulsion system can be programmed to store an optimum trim angle in the microprocessor and allow the operator to set that angle by activating a switch located at the helm of the boat. In practice, the operator would trim the outboard motor upwardly or downwardly, while in a calibrate mode indicated by a calibrate switch, until the optimum position is achieved. Then, the calibrate switch could be placed in a non-calibrate position. When that change in calibration switch is made, the microprocessor stores the optimum trim angle, as provided by the trim or tilt sensor, and prevents the outboard from being trimmed past that angle while the engine is operating. In practice, after the optimum trim position is stored in the microprocessor, the operator can trim the outboard motor to a desired position for an initial acceleration to achieve a planing position of the boat and, after the marine vessel is on plane, can activate an upward trim switch without concern of the actual position of the outboard motor. The system would continually rotate the outboard motor upwardly in response to the upward trim switch being activated by the operator until it reaches the optimum angle that is precalibrated. At that point, upward movement of the outboard motor would be prevented even though the operator continues to push the upward trim button. In this way, the outboard motor is returned to its optimum position after the boat is on plane without requiring the operator to continually trim the outboard motor upwardly and downwardly while searching for the optimum position.

Although the present invention has been described with particular detail and illustrated to show a preferred embodiment, it should be understood that alternative embodiments are also within its scope.

We claim:

1. A method for operating a trim system for a marine propulsion device, comprising the steps of:

providing a sensor which is configured to transmit a first signal which is representative of a position of said marine propulsion device;

causing said marine propulsion device to move to a desired uppermost trim position, said causing step comprising the step of responding to a manually caused actuation of a switch by energizing a hydraulic cylinder to cause said marine propulsion device to tilt upwardly relative to a marine vessel, said switch being disposed on said marine propulsion device;

receiving a second signal which is indicative of a change in a monitored condition; and storing a magnitude of said first signal when said change in said monitored condition occurs.

2. The method of claim 1, further comprising:

determining the direction of change of a magnitude of said first signal.

3. The method of claim 2, further comprising:

setting a trim limit magnitude which is a function of said direction of change of a magnitude of said first signal and said magnitude of said first signal when said change in said monitored condition occurs.

4. The method of claim 2, further comprising:

determining, as a function of said direction of change, to which side of said marine propulsion device said sensor is attached.

5. The method of claim 1, wherein:

said second signal, which is indicative of said change in said monitored condition, changes state when a ground wire is disconnected from signal communication with a microprocessor.

6. The method of claim 1, wherein:

said sensor is a potentiometer.

7. A method for operating a trim system for a marine propulsion device, comprising the steps of:

providing a sensor which is configured to transmit a first signal which is representative of a position of said marine propulsion device;

causing said marine propulsion device to move to a desired uppermost trim position, said causing step comprising the step of responding to a manually caused actuation of a switch by energizing a hydraulic cylinder to cause said marine propulsion device to tilt upwardly relative to a marine vessel, said switch being disposed on said marine propulsion device;

receiving a second signal which is indicative of a change in a monitored condition;

storing a magnitude of said first signal when said change in said monitored condition occurs; and setting a trim limit magnitude which is a function of said magnitude of said first signal when said change in said monitored condition occurs.

8. The method of claim 7, further comprising:

determining the direction of change of a magnitude of said first signal.

9. The method of claim 8, wherein:

said step of setting a trim limit magnitude is also performed a function of said direction of change of a magnitude of said first signal.

10. The method of claim 9, further comprising:

determining, as a function of said direction of change, to which side of said marine propulsion device said sensor is attached.

11. The method of claim 9, wherein:

said second signal, which is indicative of said change in said monitored condition, changes state when a ground wire is disconnected from signal communication with a microprocessor.

12. The method of claim 7, wherein:

said sensor is a potentiometer.

13. The method of claim 7, wherein:

said causing step comprises the step of responding to a manually caused actuation of a switch by energizing a hydraulic cylinder to cause said marine propulsion device to tilt upwardly relative to a marine vessel.

14. A method for operating a trim system for a marine propulsion device, comprising the steps of:

providing a sensor which is configured to transmit a first signal which is representative of a position of said marine propulsion device;

causing said marine propulsion device to move to a desired uppermost trim position;

receiving a second signal which is indicative of a change in a monitored condition;

storing a magnitude of said first signal when said change in said monitored condition occurs;

determining the direction of change of a magnitude of said first signal; and setting a trim limit magnitude which is a function of said direction of change of a magnitude of said first signal and said magnitude of said first signal when said change in said monitored condition occurs, said second signal, which is indicative of said change in said monitored condition, changing state when a ground wire is disconnected from signal communication with a microprocessor, said causing step comprising the step of responding to a manually caused actuation of a switch by energizing a hydraulic cylinder to cause said marine propulsion device to tilt upwardly relative to a marine vessel.

15. The method of claim 14, further comprising:

determining, as a function of said direction of change, to which side of said marine propulsion device said sensor is attached.

16. The method of claim 15, wherein:

said sensor is a potentiometer.

17. The method of claim 14, wherein:

said switch is disposed on said marine propulsion device.

* * * * *